US008405579B2

(12) United States Patent
Choi et al.

(10) Patent No.: US 8,405,579 B2
(45) Date of Patent: Mar. 26, 2013

(54) DATA DRIVER AND LIGHT EMITTING DIODE DISPLAY DEVICE INCLUDING THE SAME

(75) Inventors: Sang Moo Choi, Suwon (KR); Hong Kwon Kim, Euiwang (KR); Oh Kyong Kwon, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 1046 days.

(21) Appl. No.: 11/317,793

(22) Filed: Dec. 22, 2005

(65) Prior Publication Data

US 2006/0139264 A1 Jun. 29, 2006

(30) Foreign Application Priority Data

Dec. 24, 2004 (KR) ..... 10-2004-0112538
Dec. 24, 2004 (KR) ..... 10-2004-0112539

(51) Int. Cl.
*G09G 3/30* (2006.01)

(52) U.S. Cl. ..... 345/76; 345/30; 345/55

(58) Field of Classification Search ..... 345/37, 345/41–49, 60; 714/36; 713/1–100
See application file for complete search history.

(56) References Cited

U.S. PATENT DOCUMENTS

2003/0020413 A1* 1/2003 Oomura ..... 315/169.3
2003/0063081 A1 4/2003 Kimura et al.
2003/0076048 A1 4/2003 Rutherford
2004/0100430 A1 5/2004 Fruehauf
2004/0144978 A2* 7/2004 Koyama ..... 257/59
2005/0007353 A1 1/2005 Smith et al.
2006/0038758 A1* 2/2006 Routley et al. ..... 345/81
2006/0139261 A1* 6/2006 Choi et al. ..... 345/76
2006/0139263 A1* 6/2006 Choi et al. ..... 345/76
2009/0027376 A1* 1/2009 Kwon ..... 345/214
2009/0027423 A1* 1/2009 Kwon ..... 345/690

FOREIGN PATENT DOCUMENTS

CN 1369916 A 9/2002

(Continued)

OTHER PUBLICATIONS

JPO Office action dated Nov. 25, 2008 noting the references cited herewith.

SIPO Certificate of Patent dated May 11, 2011, for corresponding Chinese Patent application 200510121604.2, noting listed references in this IDS.

*Primary Examiner* — Christopher E Leiby
(74) *Attorney, Agent, or Firm* — Christie, Parker & Hale, LLP

(57) ABSTRACT

A data driver and a light emitting diode display device including the circuit that cause a pixel current through the light emitting diode to be independent of the threshold voltage of a transistor driving the light emitting diode. The data driver includes a voltage digital-analog converter for generating a data voltage and a current digital-analog converter for generating a sensing current, both corresponding to input data, and a voltage control block for receiving the pixel current that corresponds to the data voltage and is fed back from the pixel to the voltage control block changing the amount of current charging a capacitor in the voltage control block and controlling the data voltage supplied to the pixel. Controlling and adjusting the data voltage helps uniformity in the display brightness regardless of non-uniformity of transistors in each pixel.

11 Claims, 7 Drawing Sheets

FOREIGN PATENT DOCUMENTS

| | | | |
|---|---|---|---|
| CN | 1377495 | A | 10/2002 |
| CN | 1385826 | A | 12/2002 |
| JP | 2000-122608 | A | 4/2000 |
| JP | 2002-091377 | | 3/2002 |
| JP | 2003-140613 | | 5/2003 |
| JP | 2004-004675 | A | 1/2004 |
| JP | 2004-192000 | A | 7/2004 |
| WO | WO 03/107313 | A3 | 12/2003 |

* cited by examiner

DATA DRIVER AND LIGHT EMITTING DIODE DISPLAY DEVICE INCLUDING THE SAME

CROSS-REFERENCE TO RELATED APPLICATIONS

This application claims priority to and the benefit of Korean Patent Applications No. 10-2004-0112538 and No. 2004-112539, both filed on Dec. 24, 2004, in the Korean Intellectual Property Office, the entire content of both of which is incorporated herein by reference.

BACKGROUND

1. Field of the Invention

The present invention relates to a data driver and a light emitting diode display device including the same, and more particularly, to a data driver and a light emitting diode display device that display an image with desired brightness.

2. Discussion of Related Art

Various flat panel displays have recently been developed as alternatives to the relatively heavy and bulky cathode ray tube (CRT) display device. The flat panel displays include liquid crystal display devices (LCD), field emission display devices (FED), plasma display panels (PDP), light emitting diode display devices (OLED), and the like.

Among the flat panel display devices, the light emitting diode display device can emit light by electron-hole recombination. The light emitting diode display device has the advantages of relatively fast response time and relatively low power consumption. Generally, the light emitting diode display device uses a transistor in each pixel for supplying current corresponding to a data signal to a light emitting device, causing the light emitting device to emit light.

FIG. 1 illustrates a conventional light emitting diode display device 100 that includes a display region 30 including pixels 40 formed in a region defined by the intersection of scan lines S1 through Sn and data lines D1 through Dm. The conventional display 100 also includes a scan driver 10 to drive the scan lines S1 through Sn, a data driving part 20 to drive the data lines D1 through Dm, and a timing controller 50 to control the scan driver 10 and the data driving part 20.

The timing controller 50 generates a data control signal DCS and a scan control signal SCS corresponding to an external synchronization signal. The data control signal DCS and the scan control signal SCS are supplied from the timing controller 50 to the data driving part 20 and the scan driver 10, respectively. Further, the timing controller 50 supplies external data to the data driving part 20.

The scan driver 10 receives the scan control signal SCS from the timing controller 50. The scan driver 10 generates scan signals on the basis of the scan control signal SCS and supplies the scan signals to the scan lines S1 through Sn.

The data driving part 20 receives the data control signal DCS from the timing controller 50. The data driving part 20 generates data signals on the basis of the data control signal DCS and supplies the data signals to the data lines D1 through Dm while synchronizing with the scan signals.

The display region 30 receives first voltage ELVDD and second voltage ELVSS from an external power source, and supplies them to the pixels 40. When the first voltage ELVDD and the second voltage ELVSS are applied to the pixels 40, each pixel 40 controls and causes a current corresponding to the data signal to flow from a first power line supplying the first voltage ELVDD to a second power line supplying the second voltage ELVSS via a light emitting device, thereby emitting light corresponding to the data signal.

Thus, in the conventional light emitting diode display device 100, each pixel 40 emits light with a predetermined brightness corresponding to the data signal received. The pixels 40, however, cannot emit light with a desired brightness because the transistors used in the pixels 40 have different threshold voltages. Further, in the conventional light emitting diode display device 100, there is no method of measuring and controlling the real current in each pixel 40.

SUMMARY OF THE INVENTION

Accordingly, it is an aspect of the present invention to provide a data driver and a light emitting diode display device including the circuit, in which an image is displayed with desired brightness.

One aspect of the present invention is achieved by providing a data driver including a voltage digital-analog converter to generate a data voltage corresponding to the data, a current digital-analog converter to generate a sensing current corresponding to the data, and a voltage control block to receive a pixel current that flows in a pixel corresponding to the data voltage and is fed back from the pixel, to increase or decrease the amount of current charging a first capacitor, and to control the level of the data voltage to be supplied to the pixel on the basis of the level of the voltage applied to the first capacitor that is varied corresponding to the increase or decrease of the amount of current charging the first capacitor.

A second aspect of the present invention is achieved by providing a light emitting diode display device including a display region that includes scan lines, data lines, lines having a feedback function or feedback lines, and pixels coupled to the scan lines, and to the data lines and the feedback lines, a scan driver to supply scan signals to the scan lines in sequence, and a data driving part coupled to the data lines and the feedback lines, and supplying a data voltage as a data signal to the data line, wherein the data driving part includes the data driver described above.

A third aspect of the present invention is achieved by providing a data driver including a voltage digital-analog converter to generate a data voltage corresponding to the data, a current digital-analog converter to generate a sensing current corresponding to the data, and a comparator that receives a pixel current that flows in a pixel corresponding to the data voltage and is fed back from the pixel, and compares the pixel current with the sensing current to generate a first control signal, having a high voltage level, and a second control signal, having a low voltage level, the first and second control signals differing in their widths corresponding to the difference between the pixel current and the sensing current, and a current adjuster to be turned on and off by the first and second control signals to allow a current to flow in a first capacitor in response to the first control signal and the stored current to flow out from the first capacitor in response to the second control signal, and control the data voltage to be supplied to the pixel on the basis of increase or decrease of the voltage stored or being charged in the first capacitor.

A fourth aspect of the present invention is achieved by providing a method of driving a light emitting diode display device, including generating a data voltage and a sensing current corresponding to data, supplying the data voltage to a pixel, and receiving a pixel current that flows in a pixel corresponding to the data voltage and is fed back from the pixel, increasing or decreasing the amount of current charging a first capacitor, and controlling a level of the data voltage to be supplied to the pixel on the basis of a level of voltage applied to the first capacitor varied corresponding to the increase or the decrease of the amount of current charging the first capacitor.

A fifth aspect of the present invention is achieved by providing a method of driving a light emitting diode display device, including generating a data voltage and a sensing current corresponding to data, supplying the data voltage to a data line for a first period of one horizontal period, comparing the sensing current with the pixel current in a pixel corresponding to the data voltage for a second period of one horizontal period, and increasing or decreasing the amount of current charging a first capacitor on the basis of comparison, and controlling the level of the data voltage to be supplied to the pixel on the basis of the level of voltage applied to the first capacitor that is varied corresponding to the increase or decrease of the amount of current charging the first capacitor.

Another aspect of the invention provides a method for controlling image brightness corresponding to data received in an organic light emitting display device having a pixel for emitting light. The method includes generating a data voltage and a sensing current corresponding to the data, storing the data voltage in a capacitor, supplying the data voltage stored in the capacitor to the pixel to generate a pixel current corresponding to the data voltage, comparing the pixel current with the sensing current corresponding to the data, and controlling the data voltage to provide a desired image brightness by incrementing the data voltage if the pixel current is lower than the sensing current and decrementing the data voltage if the pixel current is higher than the sensing current.

As described above, the present invention provides a data driver and a light emitting diode display device including the circuit, in which a sensing current corresponding to data is compared with a pixel current in a pixel, and a data voltage (i.e. a data signal) is controlled to equalize the pixel current with the sensing current on the basis of the comparison, thereby displaying an image with a desired brightness. Particularly, according to an embodiment of the present invention, the data voltage is controlled by receiving the pixel current fed back from each pixel, so that an image is displayed with desired brightness regardless of non-uniform characteristics of the transistors used in each pixel.

DETAILED DESCRIPTION

Figure 1:
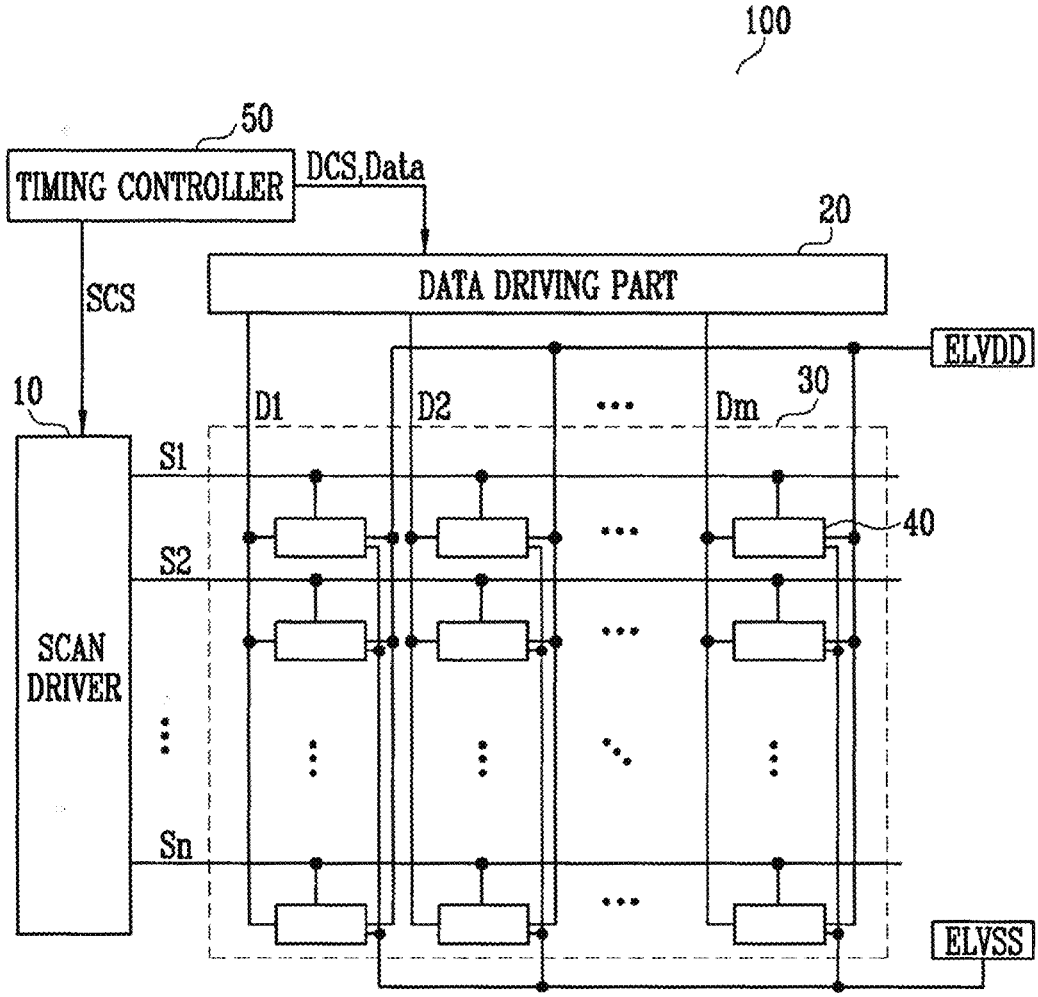
FIG. 1 (PRIOR ART)
FIG. 1 is a block diagram of a conventional light emitting diode display device.
Figure 2:
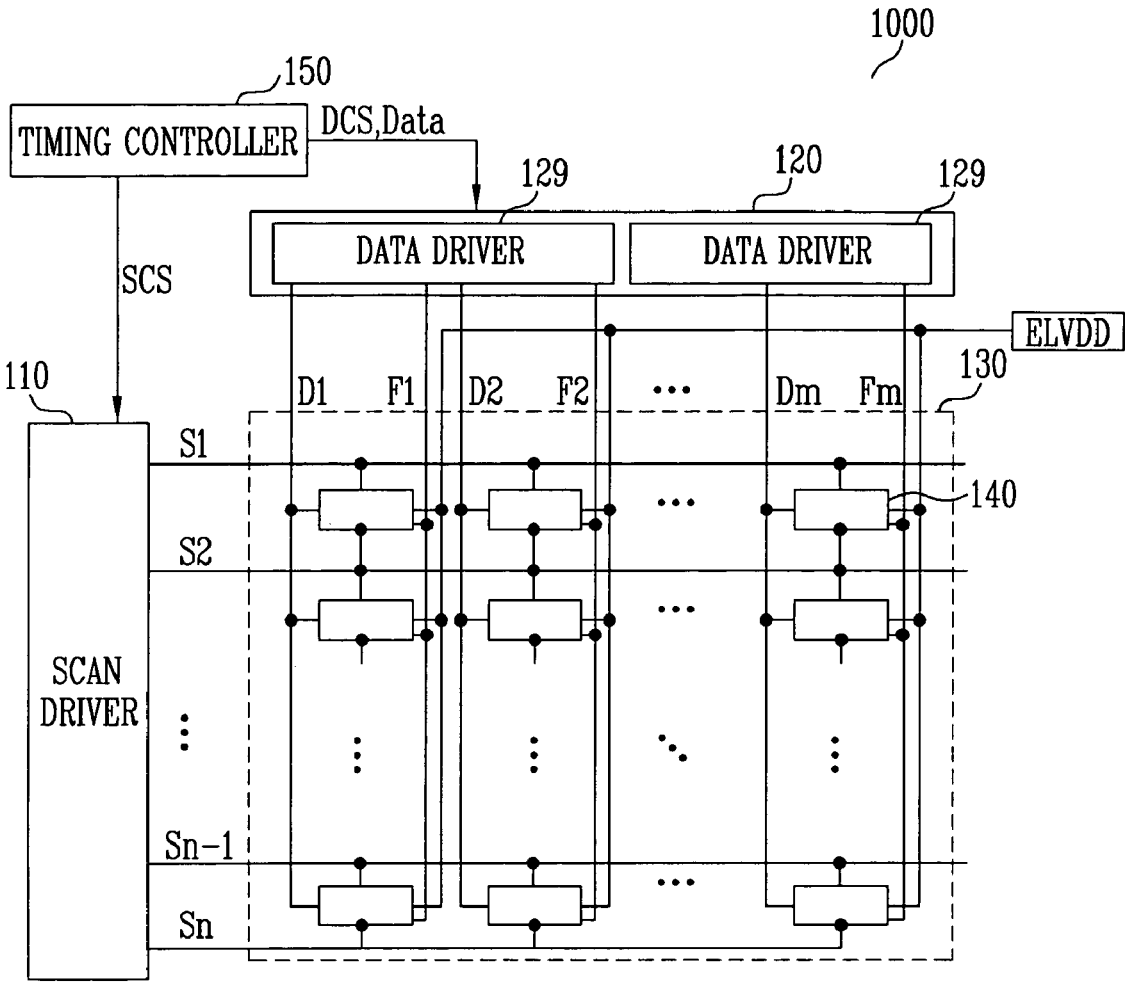
FIG. 2 is a block diagram of a light emitting diode display device according to an embodiment of the present invention.

FIG. 2 illustrates a light emitting diode display device 1000 according to an embodiment of the present invention. The light emitting diode display device 1000 of the invention includes a display region 130 that has pixels 140 formed on a region that is defined by intersection of scan lines S1 through Sn, data lines D1 through Dm, and lines having a feedback function or feedback lines F1 through Fm, a scan driver 110 to drive scan lines S1 through Sn, a data driving part 120 to drive data lines D1 through Dm, and a timing controller to control the data driving part 120.

The display region 130 includes the pixels 140 coupled with the scan lines S1 through Sn, the data lines D1 through Dm, and the feedback lines F1 through Fm. The scan lines S1 through Sn may be formed along a row direction and each supply a scan signal to the pixels 140. The data lines D1 through Dm may be formed along a column direction and each supply a data signal to the pixels 140. The feedback lines F1 through Fm receive the pixel current from the pixels 140 and supply the pixel current, that corresponds to the data signal, to the data driving part 120.

The feedback lines F1 through Fm are formed along the same direction as the data lines D1 through Dm. The feedback lines F1 through Fm receive a current from the pixels 140 to which the data signal is supplied. That is, the pixel current is generated from only those of the pixels 140 presently receiving the scan signal, and is returned to the data driving part 120 via the feedback lines F1 through Fm.

First external power having a first voltage ELVDD is also applied to the pixels 140. A second external power having a second voltage ELVSS (not shown) may also be applied to the pixels 140. When the first voltage ELVDD is applied to the pixels 140, each pixel 140 controls and generates a pixel current from the first voltage ELVDD to the light emitting device. In some embodiments, the pixel current may flow to the ground or to the second voltage ELVSS (not shown). The pixel current generated corresponds to the data signal in the data lines D1 through Dm. The pixels 140 supply the pixel current during a predetermined period time or a one horizontal period 1H (shown in FIG. 6).

The timing controller 150 generates the data driving control signal DCS and scan driving control signal SCS in response to external synchronization signals. The data driving control signal DCS and the scan driving control signal SCS are supplied to the data driving part 120 and the scan driver 110, respectively. Further, the timing controller 150 supplies a received external data Data to the data driving part 120.

The scan driver 110 receives the scan driving control signal SCS from the timing controller 150 and generates the scan signal and supplies them to the scan lines S1 through Sn in sequence.

The data driving part 120 receives the data driving control signal DCS from the timing controller 150 and generates the data signals that are supplied to the data lines D1 through Dm while synchronizing with the scan signal. The data driving part 120 applies a predetermined data voltage as a data signal to the data lines D1 through Dm.

Further, the data driving part 120 receives the pixel current from the pixels 140 via feedback lines F1 through Fm. The data driving part 120 receives the pixel current and checks whether the intensity of pixel current corresponds to the data Data. For example, in the case when the pixel current in the pixel 140 should have an intensity of 10 μA corresponding to a digital value of the data Data, the data driving part 120 checks whether the pixel current supplied from the pixel 140 is 10 μA or not.

When the desired current is not supplied to each pixel 140, the data driving part 120 controls the value of the data Data in order to send the desired current to each pixel 140. For this, the data driving part 120 includes at least one data driver 129 having j channels (where, j is a natural number). For the sake of convenience, FIG. 2 exemplarily illustrates only two data drivers 129.

Figure 3:
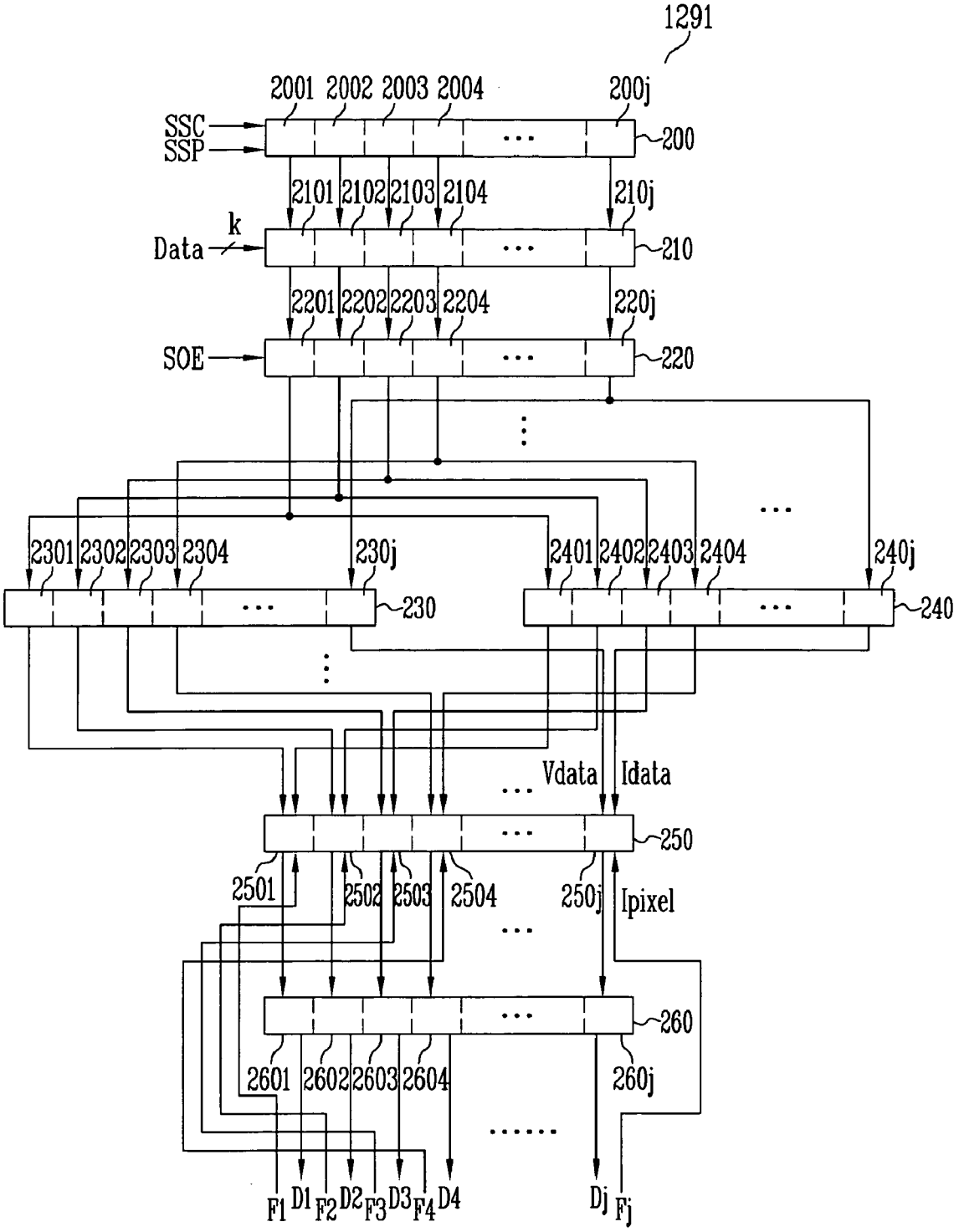
FIG. 3 is a schematic block diagram showing a first embodiment of a data driver illustrated in FIG. 2.

FIG. 3 is a schematic block diagram illustrating a first embodiment 1291 of a data driver 129 illustrated in FIG. 2. The data driver 1291 includes a shift register part 200 to generate sampling signals in sequence, a sampling latch part 210 to store the data Data in sequence in response to the sampling signals, a holding latch part 220 to temporarily store the data Data of the sampling latch part 210 and to supply the stored data Data to a voltage digital-analog converter (VDAC) 230 and to a current digital-analog converter (IDAC) 240. The VDAC 230 generates the data voltage Vdata corresponding to a voltage level of the data Data. The IDAC 240 generates the sensing current Idata corresponding to the current level of the data Data. The data driver 1291 further includes a voltage control block 250 to control the data voltage Vdata on the basis of the pixel current Ipixel supplied through the feedback lines F1 through Fj, and a buffer part 260 to supply the data voltage Vdata from the voltage control block 250 to the data lines D1 through Dj.

The shift register part 200 receives a source shift clock SSC, a source start pulse SSP from the timing controller 150, and j sampling signals sequentially while shifting the source start pulse SSP per one cycle of the source shift clock SSC. The shift register part 200 includes j shift registers (2001 through 200*j*).

The sampling latch part 210 stores the data Data in response to the sampling signals sequentially transmitted from the shift register 200. The sampling latch part 210 includes j sampling latches 2101 through 210*j* in order to store j data Data. Further, each sampling latch 2101 through 210*j* has a size corresponding to the digital value of the data Data. For example, in the case of the data Data of k bits, each sampling latch 2101 through 210*j* is set to have the size corresponding to k bits.

The holding latch part 220 receives the data Data from the sampling latch part 210 and stores it in response to a source output enable signal SOE. Further, the holding latch part 220 supplies the data Data stored to the VDAC 230 and the IDAC 240 in response to the source output enable signal SOE. The holding latch part 220 includes j holding latches 2201 through 220*j* each corresponding to k bits.

The VDAC 230 generates the data voltage Vdata corresponding to the digital value of the data Data, and supplies the data voltage Vdata to the voltage control block 250. In the example shown in FIG. 3, the VDAC 230 generates j data voltages Vdata corresponding to j data Data supplied from the holding latch part 220.

The IDAC 240 generates the sensing current Idata corresponding to the digital value of the data Data, and supplies the sensing current Idata to the voltage control block 250. In the example shown in FIG. 3, the IDAC 240 generates j sensing currents Idata corresponding to j data Data supplied from the holding latch part 220.

The voltage control block 250 receives the sensing current Idata and the pixel current Ipixel, and compares the sensing current Idata versus the pixel current Ipixel. The voltage control block 250, then, controls the data voltage Vdata on the basis of the difference between the sensing current Idata and the pixel current Ipixel. Ideally, the voltage control block 250 controls the level of the data voltage Vdata to obtain a sensing current Idata equal to the pixel current Ipixel. In the example shown in FIG. 3, the voltage control block 250 includes j voltage controllers 2501 through 250*j*.

The buffer part 260 supplies the data voltage Vdata from the voltage control block 250 to j data lines D1 through Dj. In the example shown in FIG. 3, the buffer part 260 includes j buffers 2601 through 260*j*.

Figure 4:
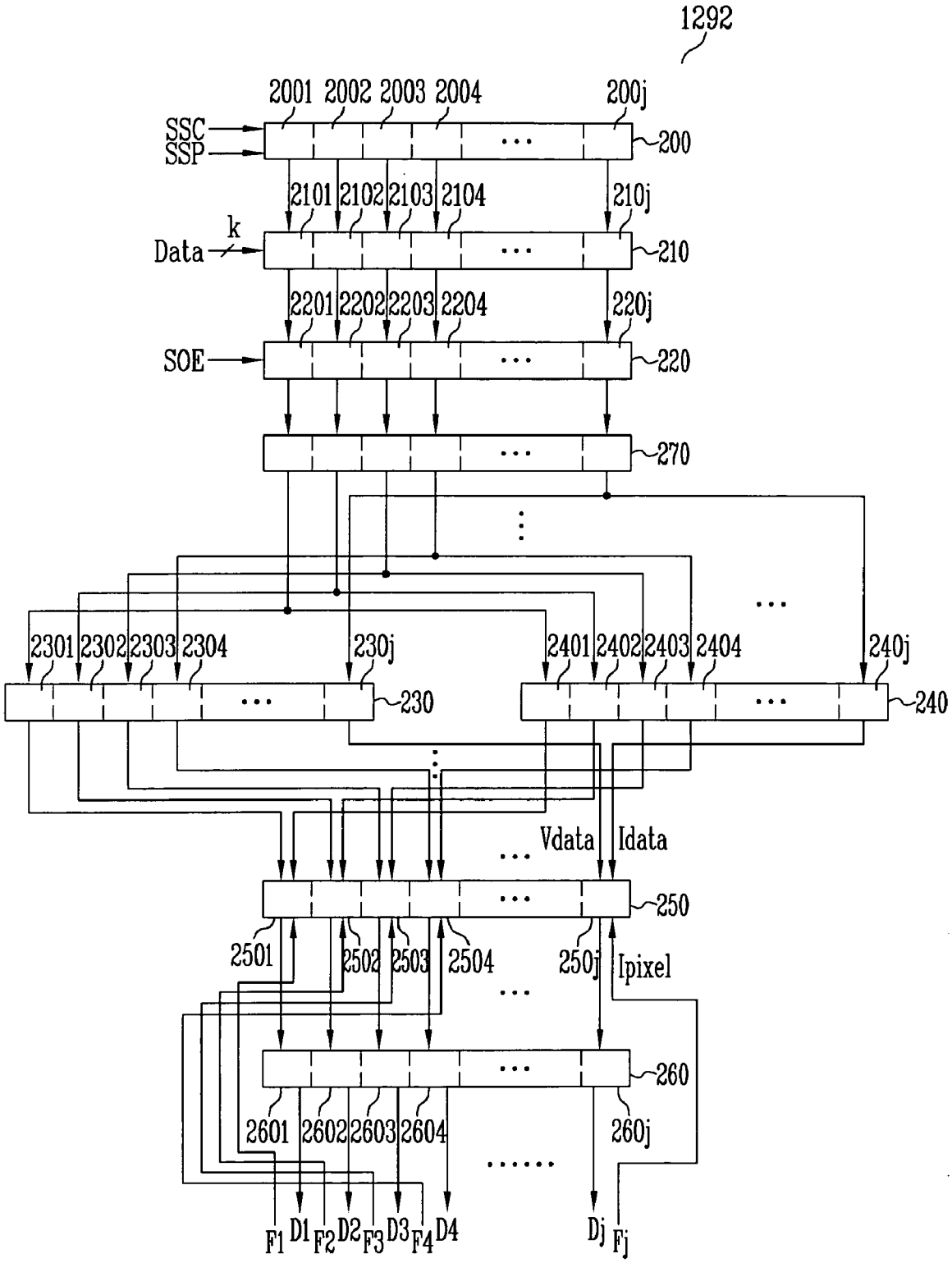
FIG. 4 is a schematic block diagram showing a second embodiment of the data driver illustrated in FIG. 2.

According to a second embodiment 1292 shown in FIG. 4, the data driver 129 may further include a level shifter part 270 between the holding latch part 220 on the input side, and the VDAC 230 and the IDAC 240 on the output side. The level shifter part 270 increments a voltage level of the data Data supplied from the holding latch part 220, and supplies it to the VDAC 230 and the IDAC 240. In the case where the data Data having a high voltage level is supplied from an external system to the data driver 1292, circuit elements corresponding to the high voltage level are needed that cause an increase in the production cost. However, according to an embodiment of the present invention, even though the external system supplies the data Data having a low voltage level to the data driver 129, the level shifter part 270 increments the voltage level of the data Data into the high level, so that the circuit elements corresponding to the high voltage level are not additionally needed, thereby reducing the corresponding production cost. The level shifter part 270 includes j level shifters 2701 through 270*j*.

Figure 5:
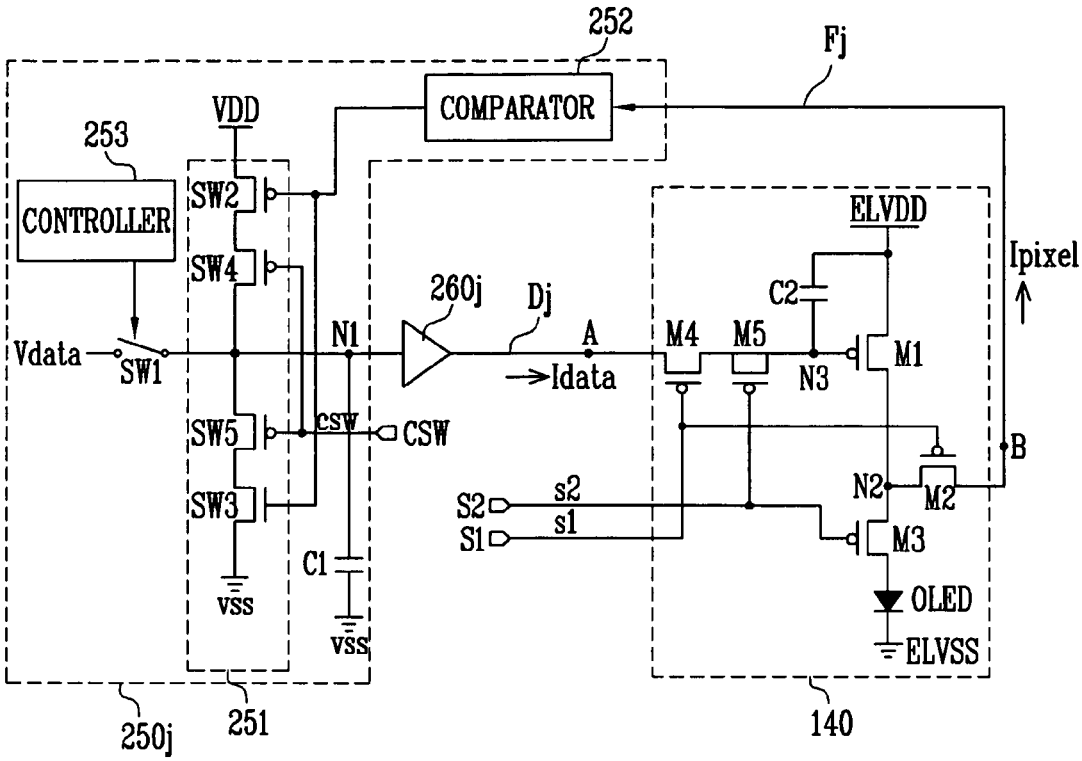
FIG. 5 is a circuit diagram showing a first embodiment of a voltage control block employed in the light emitting diode display device.

FIG. 5 is a circuit diagram illustrating a first embodiment of a voltage control block 250 employed in the light emitting diode display device 1000. For the sake of convenience, FIG. 5 illustrates the $j^{th}$ voltage controller 250*j* and the pixel 140 coupled to the $j^{th}$ voltage controller 250*j*. The voltage controller 250*j* includes a current adjuster 251, a comparator 252, a controller 253, a first capacitor C1, and a first switching device SW1. The pixel 140 includes the pixel circuit and the light emitting device OLED. The pixel circuit includes first through fifth transistors M1, M2, M3, M4, M5 and a second capacitor C2.

Figure 7:
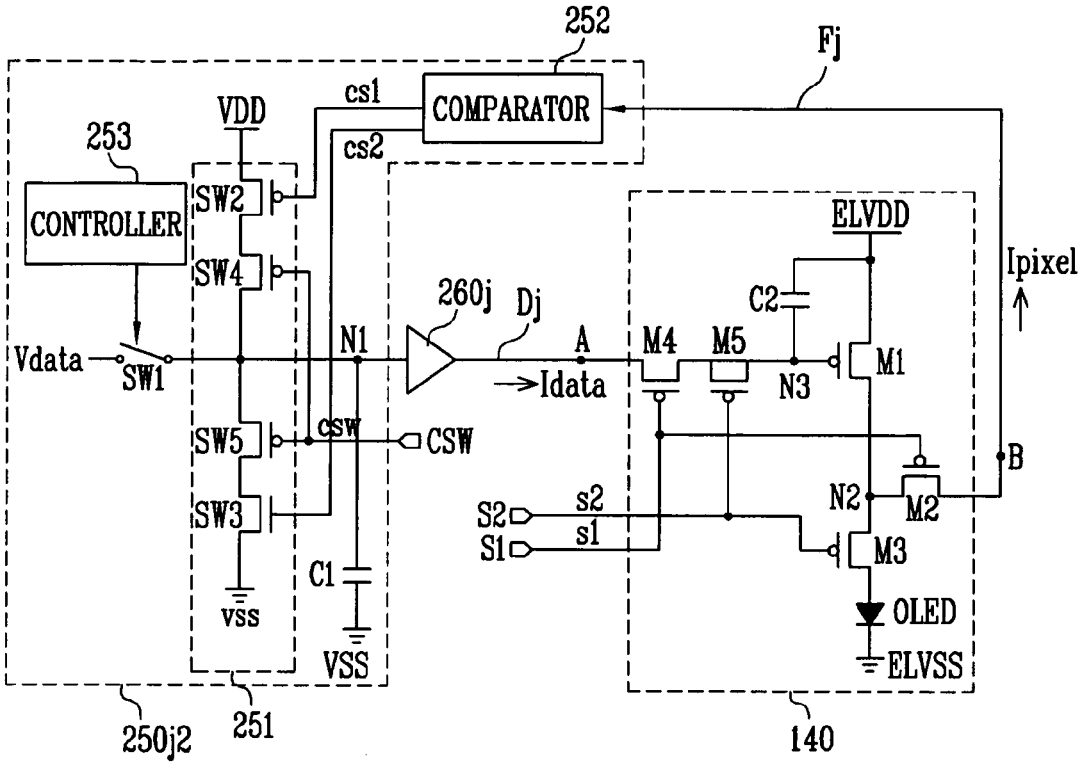
FIG. 7 is a circuit diagram illustrating a second embodiment of a voltage control block employed in the light emitting diode display device.

In the voltage controller 250*j*, the first switching device SW1 is coupled between the VDAC 230 and the current adjuster 251. The first switching device SW1 is turned on or off the controller 253. FIG. 7 Shows the inputs to the voltage control block 250*j* that occur during a data signal supplying period followed by a feedback period. In essence, the first switching device SW1 is turned on during the data signal supplying period (first period), and turned off during the feedback period (second period).

The current adjuster 251 includes second through fifth switching devices SW2, SW3, SW4, SW5. The second, fourth, and fifth switching devices SW2, SW4, SW5 are shown as PMOS transistors, and the third switching device SW3 is shown as an NMOS transistor.

The second, fourth, fifth, and third switching devices SW2, SW4, SW5, SW3 are coupled to one another in a source to drain pattern. The gate of the second switching device SW2 is coupled with the gate of the third switching device SW3. The gate of the fourth switching device SW4 is coupled with the gate of the fifth switching device SW5. The gates of the second and third switching devices SW2, SW3 are coupled to an output terminal of the comparator 252, so that the switching operations of the second and third switching devices SW2, SW3 are determined in response to an output signal of the comparator 252.

The gates of the fourth and fifth switching devices SW4, SW5 are coupled with a switching signal line CSW and receive a switching signal through the switching signal line CSW. The switching signal is supplied from the controller 253 through the switching signal line CSW (connection not shown) and determines the switching operations of the fourth and fifth switching devices SW4, SW5.

The second switching device SW2 has one terminal coupled to a third power line supplying a third voltage VDD, and the third switching device SW3 has one terminal coupled to a fourth power line supplying a fourth voltage VSS. In the example shown in FIG. 5, third voltage VDD has a higher voltage than the fourth voltage VSS, so that current flows from the third power line supplying the third voltage VDD to the fourth power line supplying the fourth voltage VSS.

The comparator 252 receives the sensing current Idata from the IDAC 240 (refer to FIG. 4) and the pixel current Ipixel from the pixel 140. The pixel current Ipixel is supplied from the pixel 140 to which the data signal is being supplied and not from the other pixels. The comparator 252 receives the sensing current Idata (shown in FIG. 4) and the pixel current Ipixel and compares the sensing current Idata with the pixel current Ipixel. The comparator 252, then transmits a control signal to the current adjuster 251 corresponding to the results of the comparison between the data and pixel currents Idata, Ipixel. The control signal transmitted by the comparator 252 varies according to the difference between the sensing current Idata and the pixel current Ipixel. When the difference between the data and pixel currents Idata, Ipixel is relatively large, the absolute voltage level of the control signal increases correspondingly. On the other hand, when the difference between the data and pixel currents Idata, Ipixel is relatively small, the absolute voltage level of the control signal decreases correspondingly. Thus, the amount of current through the second and third switching devices SW2, SW3 varies according to the voltage level of the control signal transmitted by the comparator 252.

Figure 6:
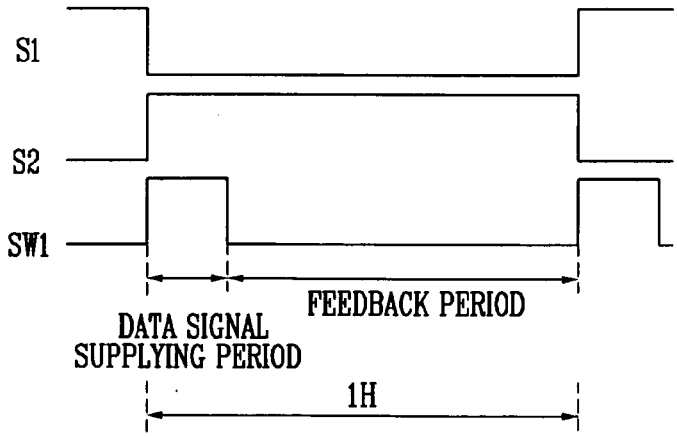
FIG. 6 shows waveforms of signals input to the voltage control block and the pixel illustrated in FIG. 5.

Referring to FIGS. 5 and 6, the controller 253 controls and causes the first switching device SW1 to be turned on during the data signal supplying period of the one horizontal period 1H, and turned off during the feedback period.

Further, the controller 253 transmits the switching signal through the switching signal line CSW to control the fourth and fifth switching devices SW4, SW5 of the current adjuster 251. When the first switching device SW1 is turned on, the controller 253 causes the fourth and fifth switching devices SW4, SW5 to be turned off, thereby supplying the data voltage Vdata from the VDAC 230 to the first node N1. On the other hand, when the first switching device SW1 is turned off, the controller 253 causes the fourth and fifth switching devices SW4, SW5 to be turned on, thereby forming a current path between the second and third switching devices SW2, SW3.

The first capacitor C1 is coupled to the first node N1, and stores the data voltage Vdata supplied from the VDAC 230 through the current adjuster 251. The data voltage Vdata to be stored in the first capacitor C1 can be varied by introducing a current through the second switching device SW2, or by draining the charge by a current through the third switching device SW3 toward the second power line that is coupled to the second voltage ELVSS.

The data voltage Vdata is supplied from the voltage controller 250*j* to the buffer 260*j* and then to the pixel 140. The buffer 260*j* amplifies the data voltage Vdata making it capable of driving a higher current. The first capacitor C1 may be a parasitic capacitor developing along the data line carrying the data voltage Vdata.

In the pixel 140, a source of the first transistor M1 is coupled to the first power line supplying the first voltage ELVDD, a drain is coupled to a second node N2, and a gate is coupled to a third node N3. The first transistor M1 generates the pixel current Ipixel and controls the level of the pixel current Ipixel based on a voltage applied to its gate that is coupled to the third node N3.

The second transistor M2 includes a source coupled to the second node N2, a drain coupled to the comparator 252, and a gate coupled to the first scan line S1. The second transistor M2 supplies the pixel current Ipixel formed by the drain current of the first transistor M1 to the comparator 252, allowing the comparator 252 to compare the pixel current Ipixel with the sensing current Idata.

The third transistor M3 includes a source coupled to the second node N2, a drain coupled to the light emitting device OLED, and a gate coupled to the second scan line S2. The third transistor M3 operates according to the second scan signal s2 input through the second scan line S2. Thus, when the pixel current Ipixel flowing through the second node N2 is equal to the sensing current Idata, the third transistor M3 transmits the pixel current Ipixel to the light emitting device OLED, thereby allowing the light emitting device OLED to emit light.

As shown in FIG. 6, the second scan signal s2 is an on-signal when the first scan signal s1 is an off-signal. Similarly, the second scan signal s2 is an off-signal when the first scan signal s1 is an on-signal. Note that for a PMOS transistor an on-signal corresponds to a low voltage level and the example shown in FIG. 5 includes PMOS second and third transistors M2, M3. Therefore, when the first scan signal s1 is the on-signal, the pixel current Ipixel is fed back to the comparator 252 through the second transistor M2. When the second scan signal s2 is the on-signal, the pixel current Ipixel is transmitted to the light emitting device OLED.

The fourth transistor M4 switches the voltage passed through the buffer 260*j* and supplies it to the third node N3. The first transistor M1 generates a current according to the voltage applied to the third node N3. A gate of the fourth transistor M4 is coupled to the first scan line S1, and performs the switching operation according to the first scan signal s1.

According to one embodiment of the present invention, the fifth transistor M5 is also included in the circuit that has its source or drain, depending on the channel type of the transistors used, coupled to the fourth transistor M4, and has its gate coupled to the second scan line S2. Including the fifth transistor M5 may help reduce error in the switching operation.

Figure 9:
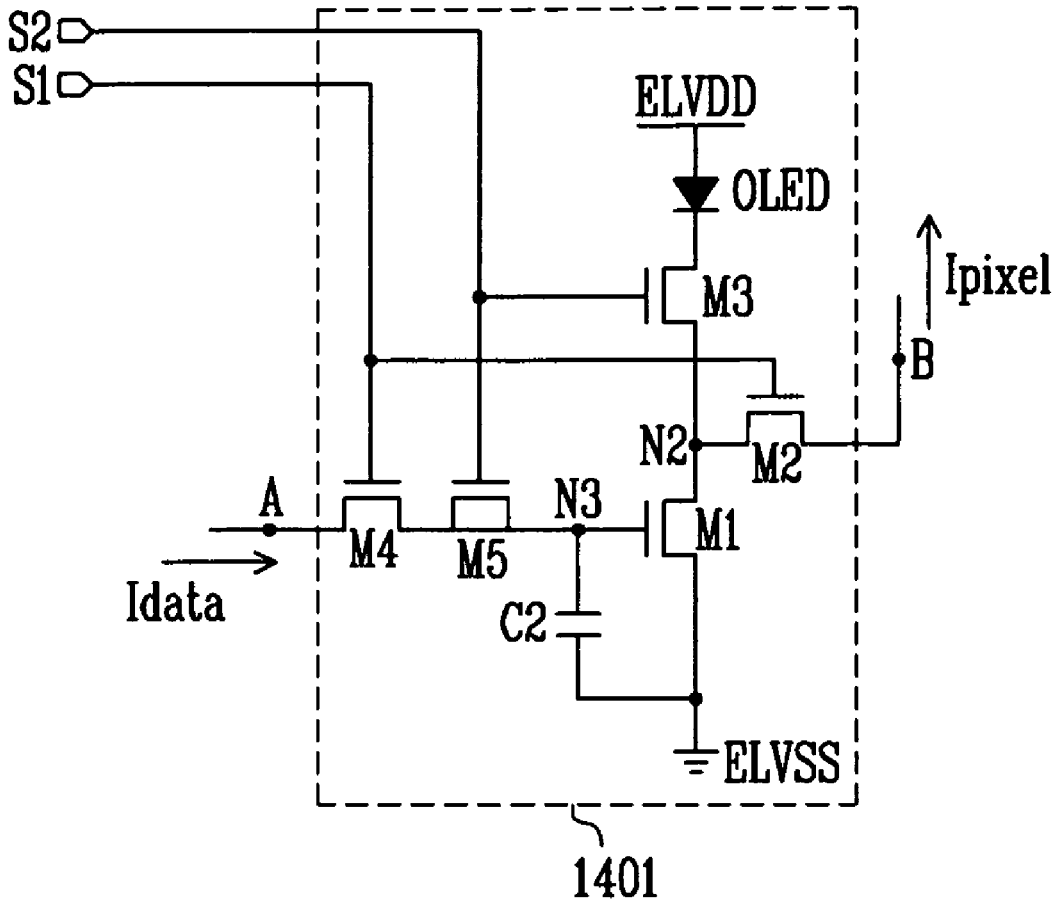
FIG. 9 is a circuit diagram of a second embodiment of the pixel illustrated in FIGS. 5 and 6.

In the exemplary embodiment shown in FIG. 5, all of the first through fifth transistors M1, M2, M3, M4, M5 used in the pixel circuit 140 are p-channel or PMOS transistors. However, as shown in FIG. 9, the first through fifth transistors M1, M2, M3, M4, M5 can be NMOS transistors too.

FIG. 6 shows waveforms of signals input to the voltage control block 250*j* and the pixel 140, illustrated in FIG. 5, which are operated as follows. First, the controller 253 turns on the first switching device SW1 for the data signal supplying period of one horizontal period 1H. As the first switching device SW1 of the voltage controller 250*j* is turned on, the data voltage Vdata is supplied from the VDAC 230*j* to the data line Dj via the buffer 260*j*. In the example shown, the data voltage Vdata is supplied as the data signal from the data line Dj to the pixel 140 selected by the scan signal. The pixel 140 receives the data signal and supplies the pixel current Ipixel corresponding to the data signal to the feedback line Fj.

During the feedback period of one horizontal period 1H, the controller 253 turns off the first switching device SW1. As the first switching device SW1 is turned off, the first node N1 enters a floating state. At this time, the level of the data voltage Vdata applied to the first node N1 is maintained by the first capacitor C1. In the example shown, the first capacitor C1 may include the parasitic capacitor developing along the data line.

During the feedback period, the comparator 252 receives the sensing current Idata from the IDAC 240 and the pixel current Ipixel from the pixels 140. The sensing current Idata is an ideal current that should flow in the pixel 140 corresponding to the data Data, and the pixel current Ipixel is the real current that flows in the pixel 140. Ideally the pixel current Ipixel should be equal to the sensing current Idata. The comparator 252 compares the pixel and sensing currents Ipixel, Idata, and generates the control signal corresponding to results of the comparison, and supplies it to the current adjuster 251.

The control signal is transmitted to the gates of the second and third switching devices SW2, SW3 of the current adjuster 251. According to the voltage level of the control signal, either the second switching device SW2 or the third switching device SW3 is turned on. Note that these devices have different channel types and an on-voltage for one will operate as an off-voltage for the other. Further, the voltage level of the control signal applied to the gates of the second and third switching devices SW2, SW3 determines the amount of current to be supplied to the data line Dj through the second switching device SW2 and the amount of current to flow out from the data line Dj through the third switching device SW3.

Accordingly, as the current is supplied to or flows out from the data line Dj, the amount of current charging the first capacitor C1 varies and thus a predetermined level of the voltage charged in the first capacitor C1 also changes. The changed voltage is supplied to the pixel 140 via the buffer 260*j*.

Further, during the feedback period, the controller 253 supplies the switching signal csw through the switching signal line CSW on the basis of the signal output from the comparator 252, thereby controlling the fourth and fifth switching devices SW4, SW5. The switching signal csw alternates between on and off signals during the feedback period, and prevents the data voltage Vdata from being changed by the third voltage VDD or the fourth voltage VSS, thereby supplying the data voltage Vdata to the first capacitor C1 when the first switching device SW1 is turned on.

Then, the pixel 140 generates the pixel current Ipixel corresponding to a predetermined voltage supplied from the first capacitor C1. The pixel 140 operates as follows. First, the fourth transistor M4 is turned on by the first scan signal s1, and the first transistor M1 generates the pixel current Ipixel that flows toward the second node N2. The amount of the pixel current Ipixel flowing in the first transistor M1 is determined in response to the voltage applied to the third node N3. The third transistor M3 is turned off by the second scan signal s2 while the second transistor M2 is also turned on by the first scan signal s1 thereby feeding back the pixel current Ipixel to the comparator 252. Eventually, when the pixel current Ipixel becomes approximately equal to the sensing current Idata through the feedback process, the voltage corresponding to the pixel current Ipixel is stored in the second capacitor C2, and the third transistor M3 is turned on, by the second scan signal s2, so that the pixel current Ipixel may be supplied to the light emitting device OLED regardless of the threshold voltage of the first transistor M1.

The foregoing processes are repeated during the feedback period, causing the pixel current Ipixel flowing in the pixel 140 to be approximately equal to the sensing current Idata.

FIG. 7 is a circuit diagram illustrating a second embodiment 250*j*2 of a voltage control block 250 employed in the light emitting diode display device 1000 of the present invention. For the sake of convenience, FIG. 7 illustrates the $j^{th}$ voltage controller 250*j*2 and the pixel 140 coupled to the $j^{th}$ voltage controller 250*j*2. The voltage controller 250*j* includes a current adjuster 251, a comparator 252, a controller 253, a first capacitor C1, and a first switching device SW1. Further, the pixel includes the pixel circuit and the light emitting device OLED, where the pixel circuit has first through fifth transistors M1, M2, M3, M4, M5 and a second capacitor C2.

In the voltage controller 250*j*2, the first switching device SW1 is coupled between the VDAC 230 and the current adjuster 251. The first switching device SW1 is turned on or off by control of the controller 253. In essence, the first switching device SW1 is turned on during a data signal supplying period (first period), and turned off during the feedback period (second period) shown in FIG. 7.

The current adjuster 251 includes second through fifth switching devices SW2, SW3, SW4, SW5. In the exemplary embodiment shown on FIG. 7, the second, fourth and fifth switching devices SW2, SW4, SW5 are PMOS transistors, and the third switching device SW3 is an NMOS transistor.

The second through fifth switching devices SW2, SW3, SW4, SW5 are coupled to one another in series with a source of one connected to the drain of an adjacent one. The gate of the fourth switching device SW4 is coupled with the gate of the fifth switching device SW5. Further, the gates of the second and third switching devices SW2, SW3 are coupled to two different output terminals of the comparator 252, so that the switching operations of the second and third switching devices SW2, SW3 are determined in response to output signals cs1, cs2 of the comparator 252.

The gates of the fourth and fifth switching devices SW4, SW5 are coupled with a switching signal line CSW, so that the fourth and fifth switching devices SW4, SW5 receive a switching signal through the switching signal line CSW. The switching signal is supplied from the controller 253 through the switching signal line CSW (connection not shown), and determines the switching operations of the fourth and fifth switching devices SW4, SW5.

The second switching device SW2 has one terminal coupled to the third power line supplying the third voltage VDD, and the third switching device SW3 has one terminal coupled to the fourth power line supplying the fourth voltage VSS. In the example shown, the third voltage VDD has a higher voltage than the fourth voltage VSS, so that current flows from the third power line supplying the third voltage VDD to the fourth power line supplying the fourth voltage VSS.

The first capacitor C1 is coupled to the first node N1, and stores the data voltage Vdata supplied from the VDAC 230 through the current adjuster 251. The data voltage Vdata to be stored in the first capacitor C1 is varied by increasing the capacitor charge by the current flowing through the second switching device SW2, or by decreasing the capacitor charge through the current flowing out in the third switching device SW3 toward the fourth power line supplying the fourth voltage VSS that could be ground.

The data voltage Vdata is supplied to the buffer 260*j*, that amplifies this voltage and supplies it to the pixel 140. The first capacitor C1 may be a parasitic capacitor along the data line.

The comparator 252 receives the sensing current Idata from the IDAC 240 and the pixel current Ipixel from the pixel 140. The pixel current Ipixel is supplied from the pixel 140 to which the data signal is currently supplied. The comparator 252 receives the sensing current Idata and the pixel current Ipixel and compares the sensing current Idata with the pixel current Ipixel, thereby transmitting a first control signal cs1 and a second control signal cs2 to the current adjuster 251 corresponding to the results of the comparison. The first control signal cs1 is transmitted to the second switching device SW2, and turns on or off the second switching device SW2.

The second control signal cs2 is transmitted to the third switching device SW3 and turns on or off the second switching device SW3.

The widths of the first and second control signals cs1, cs2 output from the comparator 252 vary according to the difference between the sensing current Idata and the pixel current Ipixel. For example, when the sensing current Idata is higher than the pixel current Ipixel and the difference between them is relatively large, the width of the first control signal cs1 is increased, so that the period of time that the second switching device SW2 is on is prolonged. As a result, the voltage increase applied to the first capacitor C1 is large, and the voltage supplied to the pixel 140 becomes higher. When the sensing current Idata is higher than the pixel current Ipixel but the difference between them is relatively small, the width of the first control signal cs1 is narrowed, so that the period while the second switching device SW2 is on is shortened. As a result, the period of supplying current to the first capacitor C1 through the second switching device SW2 is also shortened, and the increase in the voltage applied to the first capacitor C1 becomes small.

On the other hand, when the sensing current Idata is lower than the pixel current Ipixel and the difference between them is relatively large, the width of the second control signal cs2 is increased, so that a period of turning on the third switching device SW3 is prolonged. Therefore, a period of flowing out of the current stored in the first capacitor C1 through the third switching device SW3 is also prolonged, and the decrement of the voltage taken from the first capacitor C1 becomes large. When the sensing current Idata is lower than the pixel current Ipixel but the difference between them is relatively small, the width of the second control signal cs2 is narrowed, so that a period of turning on the third switching device SW3 is shortened. Therefore, a period of flowing out of the current stored in the first capacitor C1 through the third switching device SW3 is also shortened, and the decrement of the voltage taken from the first capacitor C1 becomes small.

Figure 8:
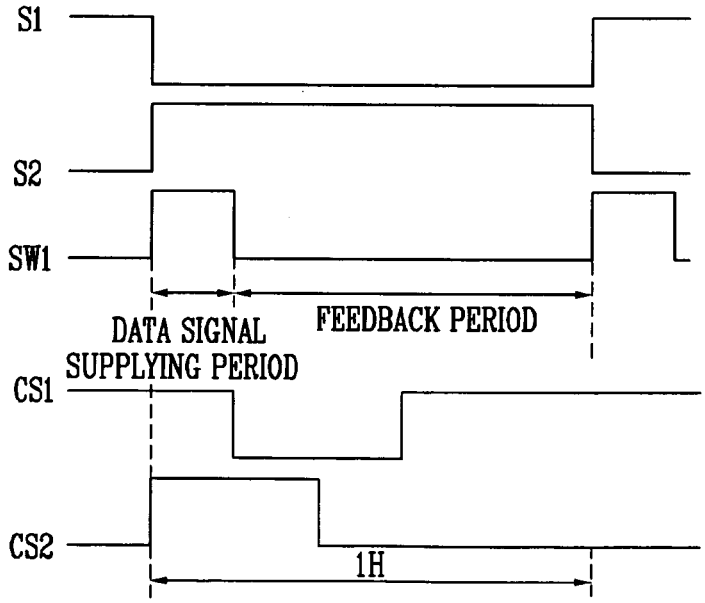
FIG. 8 shows waveforms of signals input to the voltage control block and the pixel illustrated in FIG. 7.

The controller 253 causes the first switching device SW1 to be turned on during the data signal supplying period of one horizontal period 1H, and turned off for the feedback period, shown in FIG. 8.

The controller 253 transmits the switching signal through the switching signal line CSW to control the fourth and fifth switching devices SW4, SW5 of the current adjuster 251. When the first switching device SW1 is turned on, the controller 253 causes the fourth and fifth switching devices SW4, SW5 to be turned off, thereby supplying the data voltage Vdata from the VDAC 230 to the first node. On the other hand, when the first switching device SW1 is turned off, the controller 253 causes the fourth and fifth switching devices SW4, SW5 to be turned on, thereby forming a current path between the second and third switching devices SW2, SW3.

The pixel 140 of FIG. 7 has the same structure of the pixel 140 of FIG. 5 and operates similarly as well. Further, while the circuit of the pixel 140 of FIG. 7 is shown as including PMOS transistors, alternative embodiments of the pixel circuit may be used to perform the same function. For example, the circuit of pixel 1401 of FIG. 9, that is comprised of NMOS transistors, may be used instead.

FIG. 8 shows waveforms of signals input to the voltage control block 250 including the voltage controller 250*j*2 and the pixel 140 illustrated in FIG. 7. The voltage controller 250*j*2 and the pixel 140 illustrated in FIG. 7 are operated as follows. First, the controller 253 turns on the first switching device SW1 for the data signal supplying period of one horizontal period 1H. As the first switching device SW1 of the voltage controller 250*j*2 is turned on, the data voltage Vdata is supplied from the VDAC 230*j* to the data line Dj via the buffer 260*j*. The data voltage Vdata is supplied as the data signal from the data line Dj to the pixel 140 selected by the scan signal. The pixel 140 receives the data signal and supplies the pixel current Ipixel corresponding to the data signal to the feedback line Fj.

During the feedback period of the one horizontal period 1H, the controller 253 turns off the first switching device SW1. As the first switching device SW1 is turned off, the first node N1 enters a floating state. At this time, the level of the data voltage Vdata applied to the first node N1 is maintained by the first capacitor C1. The first capacitor C1 may be comprised of the parasitic capacitance of the data line.

During the feedback period, the comparator 252 receives the sensing current Idata from the IDAC 240 and the pixel current Ipixel. The sensing current Idata is an ideal current that should flow in the pixel 140 corresponding to the data Data, and the pixel current Ipixel is the real current that flows in the pixel 140. The comparator 252 compares the pixel current Ipixel and the sensing current Idata, and based on the results of this comparison, generates the first control signal cs1 or the second control signal cs2 and supplies the generated control signal to the current adjuster 251.

The first control signal cs1 is transmitted to the gate of the second switching device SW2 of the current adjuster 251, and the second control signal cs2 is transmitted to the gate of the third switching device SW3 of the current adjuster 251. The on periods of the second and third switching devices SW2, SW3 are determined according to the widths of the first and second control signals cs1, cs2. The length of the on period determines the amount of current flowing into the first capacitor C1 through the second switching device SW2, and the amount of current flowing out of the first capacitor C1 through the third switching device SW3.

Accordingly, as current is supplied to or flows out from the data line, the amount of current charging the first capacitor C1 varies and thus a predetermined level of the voltage charged in the first capacitor C1 also changes. This changed capacitor voltage is supplied to the pixel 140 via the buffer 260*j*.

During the feedback period, the controller 253 supplies the switching signal csw through the switching signal line CSW on the basis of the signal output from the comparator 252, thereby controlling the fourth and fifth switching devices SW4, SW5. The switching signal csw alternates between on and off signals during the feedback period, and prevents the data voltage Vdata from being changed by the third voltage VDD or the fourth voltage VSS, thereby supplying the data voltage Vdata to the first capacitor C1 when the first switching device SW1 is turned on.

Then, the pixel 140 generates the pixel current Ipixel corresponding to a voltage supplied from the first capacitor C1. The pixel 140 operates as follows. First, the fourth transistor M4 is turned on when the first scan signal s1 is an on-signal which given the waveforms of FIG. 8 corresponds to an off second scan signal s2. Again, note that for PMOS transistors, such as those used in the exemplary embodiment of FIG. 7, an on-signal is a low signal and an off-signal is a high signal. As a result of the fourth transistor M4 turning on, the first transistor M1 generates the pixel current Ipixel that flows toward the second node N2. The amount of the pixel current Ipixel flowing in the first transistor M1 is determined depending on the voltage applied to the third node N3. The second transistor M2 is turned on by the first scan signal s1 when the first scan signal s1 is on or low in the case of PMOS. The third transistor M3 is turned on by the second scan signal s2 when the second scan signal is on (low for PMOS). According to the waveforms of FIG. 8, with a low first scan signal s1, the second transistor M2 is on and the third transistor M3 is off. This combination feeds back the pixel current Ipixel from the first transistor M1 through the second transistor M2, to the comparator 252. Further, when the pixel current Ipixel has finally become equal to the sensing current Idata through the feedback process, the voltage corresponding to the pixel current Ipixel is stored in the second capacitor C2. At this point, the third transistor M3 is turned on by a low second scan signal s2, so that the pixel current Ipixel that is now approximately equal to the sensing current Idata is supplied to the light emitting device OLED regardless of the threshold voltage of the first transistor M1.

According to embodiments of the present invention, the foregoing processes are repeated during the feedback period, causing the pixel current Ipixel flowing in the pixel 140 to become approximately equal to the sensing current Idata.

The present invention is not restricted to the above-described exemplary embodiments and can be modified and changed by those skilled in the art without departing from the spirit and scope of the invention as defined by the appended claims.

What is claimed is:

1. A light emitting diode display device comprising:

a display region having a scan line, a data line, a line having a feedback function, and a pixel coupled to the scan line, the data line, and the line having a feedback function, the pixel comprising a light emitting device;

a scan driver for supplying scan signals to the scan line in sequence; and a data driver coupled to the data line and to the line having a feedback function for supplying a data voltage as a data signal to the data line, the data driver including:

a voltage digital-analog converter for generating the data voltage corresponding to a data received by the data driver from an external source;

a current digital-analog converter for generating a sensing current corresponding to the data; and a voltage control block:

for selectively supplying the data voltage to a first capacitor, for receiving a pixel current supplied by a driving transistor in the pixel, the pixel current corresponding to the data voltage being supplied to a gate electrode of the driving transistor of the pixel, wherein the pixel is configured to selectively feed back the pixel current from the pixel to the voltage control block in response to an on-signal of a first scan signal of the scan signals and supply the pixel current to the light emitting device in response to an on-signal of a second scan signal of the scan signals, the on-signals of the first and second scan signals never being overlapped in time, in accordance with the scan signals, for increasing or decreasing a current charging the first capacitor based on the pixel current, and for controlling the data voltage being supplied to the pixel based on a voltage being charged in the first capacitor, the voltage being charged in the first capacitor being varied corresponding to the current charging the first capacitor, and for comparing the pixel current with the sensing current to generate a control signal for controlling the current charging the first capacitor, the control signal having a width that varies according to a difference between the pixel current and the sensing current, wherein the pixel further comprises:

a first transistor having a gate, the first transistor receiving a third power corresponding to a voltage applied to the gate and allowing a pixel current to flow through the first transistor;

a second transistor selectively receiving the pixel current in response to the first scan signal and supplying the received pixel current to a comparator;

a third transistor selectively supplying the pixel current to the light emitting device in response to the second scan signal;

a fourth transistor selectively supplying the data voltage to the gate of the first transistor in response to the first scan signal; and a second capacitor for maintaining a voltage applied to the gate of the first transistor during a predetermined period.

2. The light emitting diode display device according to claim 1, further comprising a fifth transistor coupled between the fourth transistor and the gate of the first transistor and supplying a voltage from the fourth transistor to the gate of the first transistor.

3. The light emitting diode display device according to claim 1, wherein the second scan signal and the first scan signal have inverted waveforms.

4. The light emitting diode display device according to claim 1, wherein the second capacitor stores a voltage for equalizing the pixel current with the sensing current.

5. The data driver according to claim 1, further comprising:

a shift register part for generating sampling signals in sequence; and a latch part for receiving the sampling signals generated by the shift register and for supplying the data to the voltage digital-analog converter and to the current digital-analog converter according to the sampling signals received.

6. The data driver according to claim 5, wherein the latch part comprises:

a sampling latch part for storing the data according to the sampling signal; and a holding latch part for storing the data of the sampling latch part and for supplying the stored data to the voltage digital-analog converter and to the current digital-analog converter.

7. The data driver according to claim 6, further comprising a level shifter part for incrementing a voltage level of the data stored in the holding latch part and for supplying the data having an incremented voltage level to the voltage digital-analog converter and to the current digital-analog converter.

8. A light emitting diode display device comprising:

a display region having a scan line, a data line, a line having a feedback function, and a pixel coupled to the scan line, the data line, and the line having a feedback function, the pixel comprising a light emitting device;

a scan driver for supplying scan signals to the scan line in sequence; and a data driver coupled to the data line and to the line having a feedback function for supplying a data voltage as a data signal to the data line, the data driver includes:

a voltage digital-analog converter for generating the data voltage corresponding to a data received by the data driver from an external source;

a current digital-analog converter for generating a sensing current corresponding to the data; and a comparator:

for receiving a feedback pixel current supplied by a driving transistor in the pixel, the pixel current corresponding to the data voltage being supplied to a gate electrode of the driving transistor of the pixel, wherein the pixel is configured to selectively feed back the pixel current from the pixel to the voltage control block in response to an on-signal of a first scan signal of the scan signals and supply the pixel current to the light emitting device in response to an on-signal of a second scan signal of the scan signals, the on-signals of the first and second scan signals never being overlapped in time, in accordance with the scan signals, for comparing the pixel current with the sensing current; and for generating a first control signal and a second control signal having widths being varied according to a difference between the pixel current and the sensing current; and a current adjuster being turned on and off by the first control signal and the second control signal for allowing a current to flow to a first capacitor based on the first control signal and for allowing a current to flow out from the first capacitor based on the second control signal, and for controlling the data voltage to be supplied to the pixel based on an increase or decrease of the current out from the first capacitor, wherein the pixel further comprises:

a first transistor having a gate, the first transistor receiving a third power corresponding to a voltage applied to the gate and allowing a pixel current to flow through the first transistor;

a second transistor selectively receiving the pixel current in response to the first scan signal and supplying the received pixel current to a comparator;

a third transistor selectively supplying the pixel current to the light emitting device in response to the second scan signal;

a fourth transistor selectively supplying the data voltage to the gate of the first transistor in response to the first scan signal; and a second capacitor for maintaining a voltage applied to the gate of the first transistor during a predetermined period.

9. The light emitting diode display device according to claim 8, further comprising a fifth transistor coupled between the fourth transistor and the gate of the first transistor, and supplying a voltage from the fourth transistor to the gate of the first transistor.

10. The light emitting diode display device according to claim 8, wherein the second scan signal and the first scan signal have inverted waveforms.

11. The light emitting diode display device according to claim 8, wherein the second capacitor stores a voltage for equalizing the pixel current with the sensing current.

* * * * *